US006874332B2

(12) United States Patent
Forgach

(10) Patent No.: US 6,874,332 B2
(45) Date of Patent: Apr. 5, 2005

(54) COOLING SYSTEM FOR PROTECTIVE VEST

(76) Inventor: Paul A. Forgach, 1932 Shimizu Dr., Stockton, CA (US) 95203

( * ) Notice: Subject to any disclaimer, the term of this patent is extended or adjusted under 35 U.S.C. 154(b) by 561 days.

(21) Appl. No.: 10/127,275

(22) Filed: Apr. 22, 2002

(65) Prior Publication Data

US 2003/0196254 A1 Oct. 23, 2003

(51) Int. Cl.[7] ..... F25D 23/12
(52) U.S. Cl. ..... 62/259.3; 165/46
(58) Field of Search ..... 62/259.1, 259.3, 62/314, 404, 419, 89; 165/46

(56) References Cited

U.S. PATENT DOCUMENTS

| | | | | |
|---|---|---|---|---|
| 3,348,236 | A | | 10/1967 | Copeland |
| 3,468,299 | A | | 9/1969 | D'Amato |
| 4,019,508 | A | * | 4/1977 | Der Estephanian et al. ..... 128/202.19 |
| 4,162,764 | A | | 7/1979 | Millsap |
| 4,194,247 | A | | 3/1980 | Melander |
| 4,741,333 | A | * | 5/1988 | Suzuki et al. ..... 128/201.23 |
| 4,821,339 | A | * | 4/1989 | Fair ..... 2/462 |
| 4,964,282 | A | * | 10/1990 | Wagner ..... 62/259.3 |
| 5,146,625 | A | * | 9/1992 | Steele et al. ..... 2/102 |
| 5,217,408 | A | * | 6/1993 | Kaine ..... 454/338 |
| 5,515,543 | A | | 5/1996 | Gioello |
| 5,564,124 | A | | 10/1996 | Elsherif et al. |
| 5,692,238 | A | * | 12/1997 | Watson, Jr. ..... 2/102 |
| 5,970,519 | A | * | 10/1999 | Weber ..... 2/81 |
| 5,976,176 | A | * | 11/1999 | Webb, II ..... 607/104 |
| 6,105,382 | A | * | 8/2000 | Reason ..... 62/259.3 |
| 6,128,784 | A | | 10/2000 | Frank |
| 6,131,645 | A | | 10/2000 | Barr |
| 6,257,011 | B1 | | 7/2001 | Siman-Tov et al. |
| 6,260,201 | B1 | | 7/2001 | Rankin |
| 6,276,155 | B2 | * | 8/2001 | Siman-Tov et al. ..... 62/259.3 |
| 6,341,384 | B1 | * | 1/2002 | Hayes ..... 2/458 |
| 6,543,247 | B2 | * | 4/2003 | Strauss ..... 62/259.3 |

FOREIGN PATENT DOCUMENTS

| | | | |
|---|---|---|---|
| JP | 404080536 A | * | 3/1992 |
| JP | 11131308 A | * | 5/1999 |

* cited by examiner

*Primary Examiner*—Denise Esquivel
*Assistant Examiner*—Mohammad M. Ali
(74) *Attorney, Agent, or Firm*—Cahill, von Hellens & Glazer, P.L.C.

(57) ABSTRACT

A protective vest includes a cooling system including an elongated housing generally disposed inside the protective vest. At least one fan powered by an electric motor is supported at the upper end of the elongated housing proximate the neck opening of the protective vest for drawing fresh air into the upper end of the elongated housing. The elongated housing includes a retractable extension for varying the length thereof. Ventilation holes are formed in the elongated housing to discharge fresh air between the protective vest and the user's body. Electrical wires extend from the motor to a battery worn by the user, or to a vehicle cigarette lighter, to supply power to the motor. The electrical wires incorporate a quick-disconnect coupling and a switch/dimmer control to control the speed of the fan.

27 Claims, 5 Drawing Sheets

COOLING SYSTEM FOR PROTECTIVE VEST

BACKGROUND OF THE INVENTION

1. Field of the Invention

The present invention relates generally to protective vests or other enclosures worn about a person's upper torso, and more particularly, to a cooling mechanism and related method for cooling the body of a user wearing such a protective vest.

2. Description of the Related Art

To help prevent fatal injuries to law enforcement officers, many police and other law enforcement departments mandate that officers where a protective bulletproof vest while on duty. However, during summer months in the Southern and Southwestern regions of the United States, such protective vests can become extremely uncomfortable, trapping body heat and moisture, and interfering with the evaporation of sweat. In some cases, officers become so uncomfortable that they remove such protective vests, posing the risk of serious injury in the event of an unexpected confrontation with a violent subject.

Those skilled in the art have in the past attempted to solve such problem. For example, U.S. Pat. No. 6,128,784 to Frank discloses a protective vest having air-circulating conduits incorporated therein. However, the apparatus disclosed by Frank does not appear to have any mechanism to forcibly circulate such air through such conduit.

U.S. Pat. No. 6,131,645 to Barr discloses a cooling system for use by law enforcement officers while riding or sitting in a vehicle, and relies upon cooled air supplied by the vehicle air conditioning system. A flexible hose has one end secured over an air conditioning vent and another end that is inserted under the user's protective vest. In an emergency, a quick-disconnect feature allows the user to disconnect the hose coupling so that the officer can rapidly leave the vehicle. However, no mechanism is provided for cooling the officer once the officer leaves the vehicle.

In U.S. Pat. No. 4,964,282 to Wagner, an air cooling apparatus is disclosed for cooling a bullet proof vest wherein a tubular belt worn about the user's waist has air discharge holes formed around the belt for releasing cooling air under the protective vest. The tubular belt couples with a flexible hose designed to fit over an air conditioning vent within a vehicle in a manner similar to that described above in conjunction with the patent to Barr. In addition, the tubular belt can also be connected to a blower unit having a motor-driven fan coupled to a source of electrical power.

U.S. Pat. No. 6,257,011 to Siman-Tov, et al. discloses a portable cooling device for use with body armor systems to evaporate sweat and provide cooling. A belt incorporates an air moving device, operated by rechargeable batteries, for distributing air through channels formed within the vest.

Recently issued U.S. Pat. No. 6,260,201 to Rankin discloses a portable cooling device formed in a garment that includes tubular members interconnected by a connector tube. Openings formed in the tubular members distribute cooling air about the user's body. Air is pumped to the connector tube by an air pump via a supply tube. The electrical supply for the air pump is a plug adapted to engage a cigarette lighter of an automobile; batteries may also be used. Alternatively, an air conditioning vent of a vehicle can be used as the source of cooling air.

However, none of the devices described above are adapted to be quickly and easily inserted or removed, while at the same time being self-contained for use both inside and outside of a vehicle. Moreover, none of the devices described above is easily adjustable to suit the specific needs of a particular user. In addition, the devices described above are relatively expensive, or require significant modification of the design of existing bullet proof vests.

Accordingly, it is an object of the present invention to provide a protective vest assembly having a cooling system for circulating fresh, cooling air between the vest and the user's body.

Another object of the present invention is to provide such a protective vest assembly that is adapted to be used both within a motor vehicle as well as remote from the motor vehicle.

Still another object of the present invention is to provide such a protective vest assembly that can easily be adapted to existing protective vests already in use by law enforcement officers.

Yet another object of the present invention is to provide such a protective vest assembly that is relatively inexpensive to manufacture.

A further object of the present invention is to provide such a protective vest assembly that can be quickly and easily disconnected from an electrical power source.

A still further object of the present invention is to provide such a protective vest assembly that can be quickly and easily inserted or removed by a user.

Yet another object of the present invention is to provide such a protective vest assembly that can be easily adjusted by a user to suit the specific needs of the user.

These and other objects of the present invention will become more apparent to those skilled in the art as the description of the present invention proceeds.

SUMMARY OF THE INVENTION

Briefly described, and in accordance with a preferred embodiment thereof, the present invention relates to a cooling system for a protective vest. The cooling system includes an elongated housing generally disposed inside the protective vest. A fan is supported at the upper end of the elongated housing and extends just outside the neck opening of the protective vest for drawing in fresh air. For example, the fan might extend outside the neck opening of the protective vest just in front of the user's neck. Alternatively, the fan might extend outside the neck opening of the protective vest just behind the user's neck. The fan is rotated by an electric motor that is supported proximate the upper end of the elongated housing. At least one ventilation hole is formed in the elongated housing below the upper end thereof for discharging fresh air between the protective vest and the body of the user. Electrical wires are coupled to the electric motor for supplying electrical power thereto.

In one embodiment, these electrical wires are coupled to a battery for supplying electrical power to the electric motor. The battery can be worn upon the user's person, for example, by supporting the battery via a belt worn by the user. Ideally, an electrical switch is coupled with the electrical wires to selectively couple the battery to the electric motor. Preferably, the electrical wires include a quick-disconnect coupling for releasably coupling the battery to the electric motor. If desired, an electrical dimmer switch, variable resistor, rheostat, or similar control can be coupled with the electrical wires to adjust the electrical current applied to the electric motor for varying the speed of the fan.

In an alternate embodiment of the protective vest assembly, the electrical wires leading to the electric motor are coupled to an electrical adaptor designed to engage a vehicle cigarette lighter in order to supply electrical power from a vehicle to the electric motor while the user is driving, or sitting within, the vehicle. Once again, the electrical wires preferably include a quick-disconnect coupling for releasably coupling the electric motor of the cooling system to the vehicle cigarette lighter.

In order to better suit the needs of various users, the protective vest cooling system preferably includes a retractable extension slidingly received within the lower end of the elongated housing, to effectively vary the length of the elongated housing. The retractable extension includes at least one ventilation hole for discharging fresh air between the protective vest and the body of the user. This ventilation hole may, for example, be the open lower end of the retractable extension member.

For improved cooling capacity, a second fan can be supported at the upper end of the elongated housing adjacent the first fan, and a second electric motor can be supported proximate the upper end of the elongated housing and coupled to the second fan for rotating the second fan. The aforementioned electrical wires can be coupled in parallel with the second electric motor to power both fans simultaneously, or the fans can be controlled individually.

The present invention also relates to a method of cooling a person using a protective vest. A first fan is supported at the upper end of an elongated housing. An electric motor is coupled to the fan for rotating the fan, thereby drawing fresh air into the upper end of the elongated housing. Electrical power is supplied to the electric motor to rotate the fan. The elongated housing is inserted into the protective vest, while positioning the fan just outside the neck opening of the protective vest. In practicing the method of the present invention, the user may position the fan outside the neck opening just ahead of, or alternately just behind, the user's neck. At least one ventilation hole is formed in the elongated housing below its upper end, and fresh air drawn in by the fan is discharged through the ventilation hole between the protective vest and the user's body.

When practicing such method, the electric motor can be electrically coupled with a battery; the method may include the step of supporting the battery upon the user's person, as by supporting the battery from a waist belt. Alternatively, the method of the present invention may include the step of electrically coupling the electric motor to an electrical adaptor, and engaging the adaptor with a vehicle cigarette lighter to supply electrical power to the motor. In either case, the method preferably includes providing a quick-disconnect coupling to releasably couple the motor to the source of electrical power. The method may also include the step of interposing an electrical switch between the electric motor and source of electrical power to selectively operate the fan.

The aforementioned cooling method preferably includes the step of slidingly engaging a retractable extension with the lower end of the elongated housing to adjustably lengthen the elongated housing, and forming at least one ventilation hole within the retractable extension, for example, within the lower end thereof, for discharging fresh air between the protective vest and the body of the user.

The cooling method described above can be further enhanced by supporting a second fan at the upper end of the elongated housing, providing a second electric motor for rotating the second fan, and supplying electrical power to the second electric motor for rotating the second fan.

DETAILED DESCRIPTION OF THE PREFERRED EMBODIMENT

Figure 1:
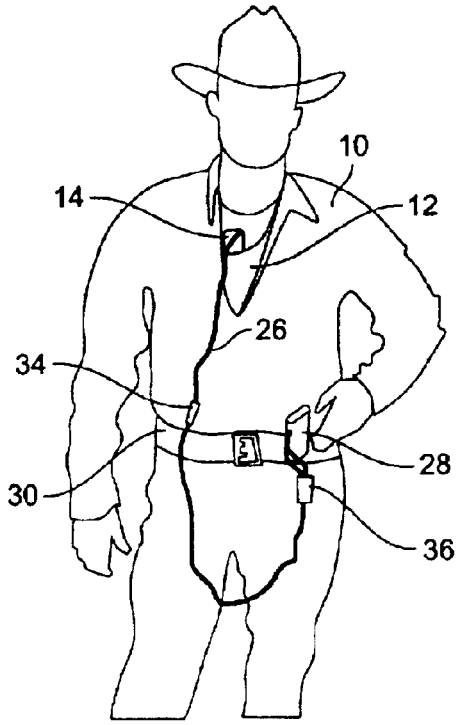
FIG. 1 is a frontal view of a person wearing a protective vest incorporating a cooling device in accordance with the present invention and using a battery supported on the user's waist belt.
Figure 4:
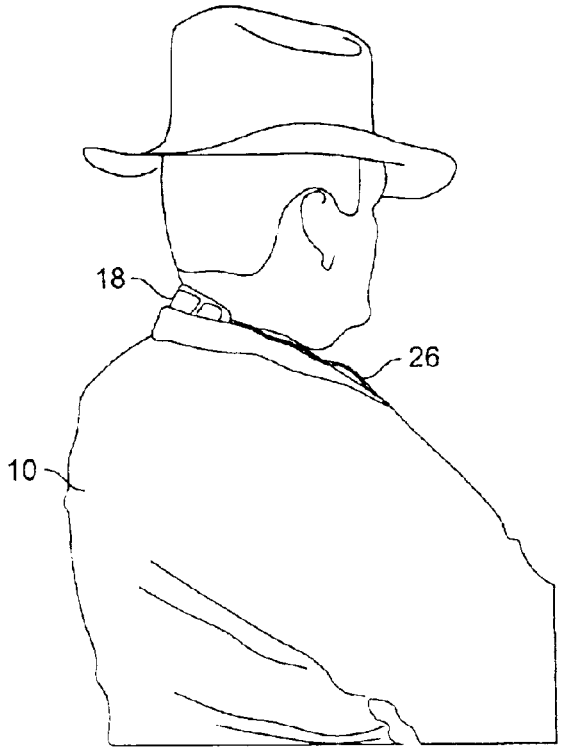
FIG. 4 is a rear view of a person using such a cooling device but wherein the cooling device is inserted through the neck opening of the protective vest generally behind the user's neck.

FIG. 1 illustrates a cooling system for a protective vest in accordance with one preferred embodiment of the present invention. Within FIG. 1, the user is identified generally by reference numeral 10, the protective vest by reference numeral 12, and the cooling device by reference numeral 14. Cooling device 14 includes an elongated housing 16 (see FIG. 5) disposed inside protective vest 12. A fan 18 (see FIG. 5) is supported at the upper end 20 of elongated housing 16; as shown in FIG. 1, fan 18 extends just outside the neck opening of protective vest 12 for drawing in fresh air. Within both FIGS. 1 and 2, fan 18 extends outside the neck opening of protective vest 12 just in front of the neck of user 10. Turning briefly to FIG. 4, fan 18 may alternately extend outside the neck opening of protective vest 12 just behind the neck of user 10.

Fan 18 is rotated by an electric motor 22 supported proximate upper end 20 of elongated housing 16. Preferably, motor 22 is integral with fan 18, and may be a 12 volt, 1.08 Watt ball-bearing cooling fan assembly of the type commercially available from Yen Sun Technology Corporation (Y.S. Tech) under Model No. FD1240107S-1N.Electrical wires are coupled to the electric motor for supplying electrical power thereto. Fan 18 and motor 22 may advantageously be pivotally coupled to upper end 20 by pivot pin 24 (see FIG. 5) for allowing fan 18 to be directed at different angles when being worn by user 10.

Figure 2:
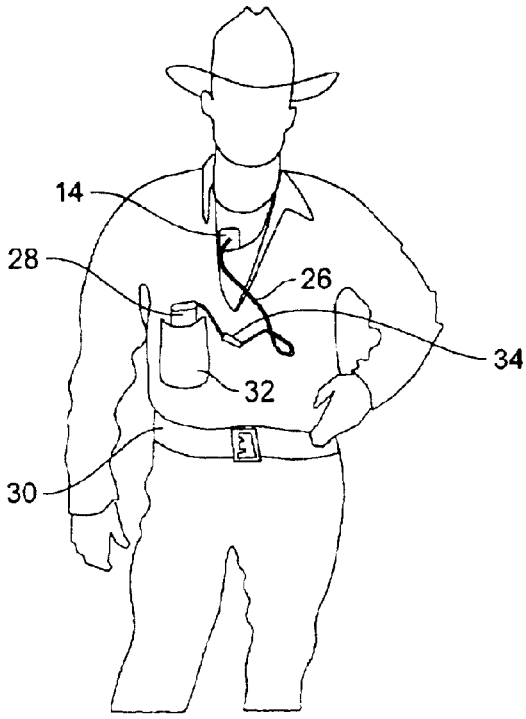
FIG. 2 is a frontal view of a person wearing a protective vest incorporating the cooling device shown in FIG. 1 and using a battery supported in the user's shirt pocket.

Electrical power wires 26 extend from motor 22 to a source of electrical power. The upper portion of such wires may be reinforced, if desired, by a supporting sheath 27 to better resist flexing of wires 26 adjacent cooling device 14. In the embodiments shown in FIGS. 1, 2 and 5, electrical wires 26 are coupled to a battery pack 28 for supplying electrical power to electric motor 22. Battery pack 28 may contain conventional disposable batteries or rechargeable batteries, and can be worn upon the person of user 10, for example, via a waist belt 30 (as shown in FIG. 1) or in the user's shirt pocket 32 (as shown in FIG. 2). Ideally, an electrical switch 34 is coupled in series with electrical wires 26 to selectively couple electrical power to motor 22. In addition, electrical wires 26 may also include a quick-disconnect coupling 36 for releasably coupling battery pack 28 to motor 22. This quick-disconnect feature allows a user to charge one battery pack while another is in use. The quick-disconnect feature also permits electrical wires 26 to be coupled with alternative d.c. power sources, as will be explained below in conjunction with FIG. 3.

Figure 6:
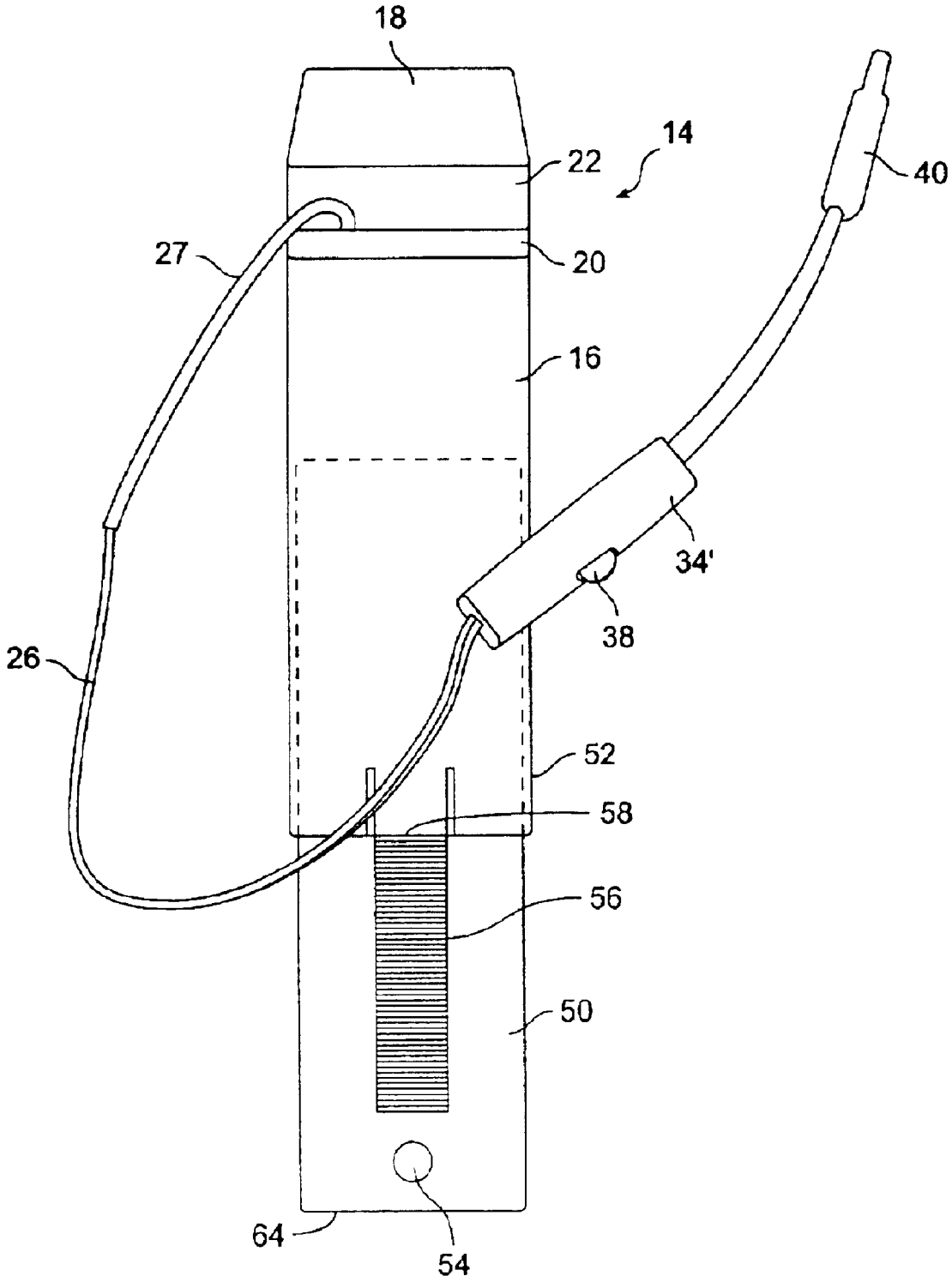
FIG. 6 is a front view of the cooling device equipped with a cigarette lighter adaptor, and including a rheostat control for varying the speed of the fan.

Turning for a moment to FIG. 6, those skilled in the art will appreciate that electrical switch 34 can be replaced by a so-called dimmer switch, rheostat, or variable resistor 34' to allow a user to vary the speed of the fan by adjusting the amount of electrical current supplied by electrical wires 26. Rotation of control wheel 38 serves to increase or decrease the amount of electrical current supplied, and hence controls the speed of fan 18.

Figure 3:
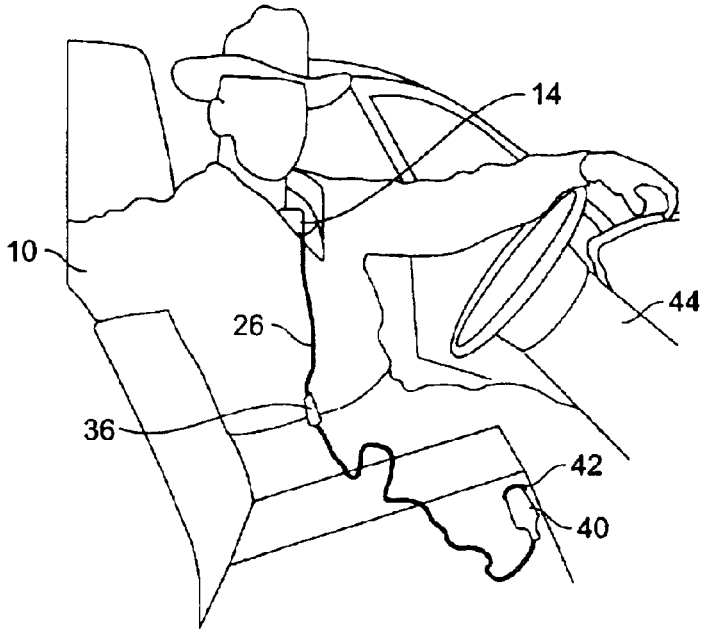
FIG. 3 illustrates an alternate embodiment of the present invention wherein the user is seated in a vehicle, and wherein the cooling device includes an adaptor for engaging a vehicle cigarette lighter.

Referring now to FIG. 3, an alternate embodiment of the protective vest cooling device is shown wherein electrical wires 26 are coupled to an electrical adaptor 40 designed to engage cigarette lighter socket 42 of vehicle 44 in order to supply electrical power from the 12 volt vehicle storage battery to motor 22 while user 10 is driving, or sitting within, vehicle 44. Electrical wires 26 again preferably include quick-disconnect coupling 36 for releasably coupling motor 22 of cooling device 14 to the vehicle cigarette lighter adapter 40. This quick-disconnect feature is especially valuable in those instances when a law enforcement officer must quickly leave vehicle 44. Though not shown in FIG. 3, those skilled in the art will understand that rheostat 34' may be incorporated within electrical wires 26 to allow user 10 to vary the fan speed of cooling device 14.

Figure 5:
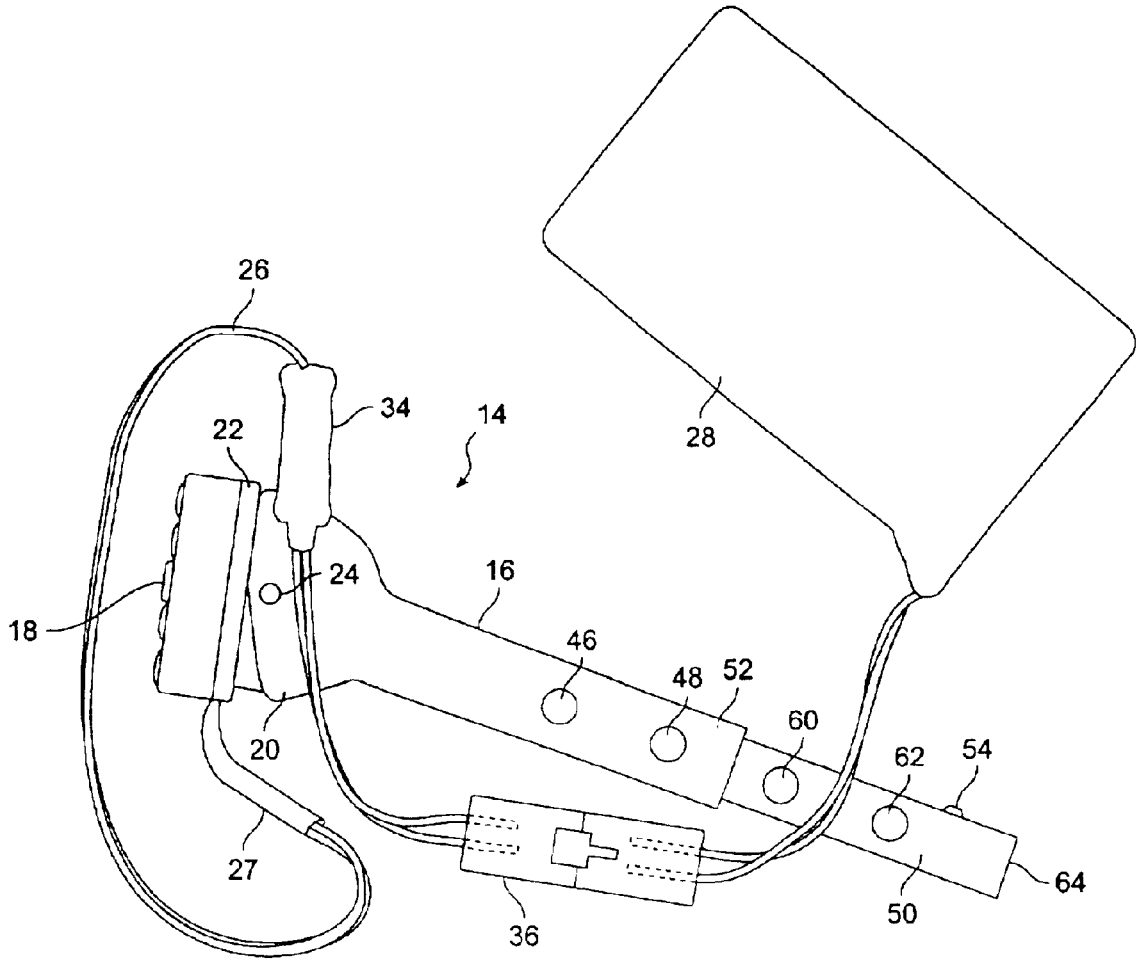
FIG. 5 is a side view of the cooling device, including a retractable extension member, and including a quick-disconnect coupling between the fan motor and a battery pack.

Referring now to FIGS. 5 and 6, it will be noted that several ventilation holes 46 and 48 are formed in elongated housing 16 below upper end 20 thereof for discharging fresh air between protective vest 12 and the body of user 10. In order to better suit the needs of various users, cooling device 14 also includes a retractable extension member 50 that is slidingly received within lower end 52 of elongated housing 16; retractable extension member 50 effectively varies the length of elongated housing 16. A lug 54 protrudes outwardly from the lower end of extension member 50 in order to prevent extension member 50 from becoming trapped inside housing 16. If desired, a series of ridges 56 may be formed upon retractable extension member 50 for being engaged by a tooth 58 formed on lower end 52 of housing 16 for retaining extension member 50 at a desired position. Retractable extension member 50 includes ventilation holes 60 and 62 for discharging fresh air between protective vest 12 and the body of user 10 when extension member 50 is pulled out from lower end 52 of housing 16. Holes 60 and 62 can also be aligned with holes 46 and 48 when extension member 50 is retracted inside housing 16. In addition, the lower end 64 of retractable extension member 50 is also preferably open to serve as a ventilation hole.

Figure 7:
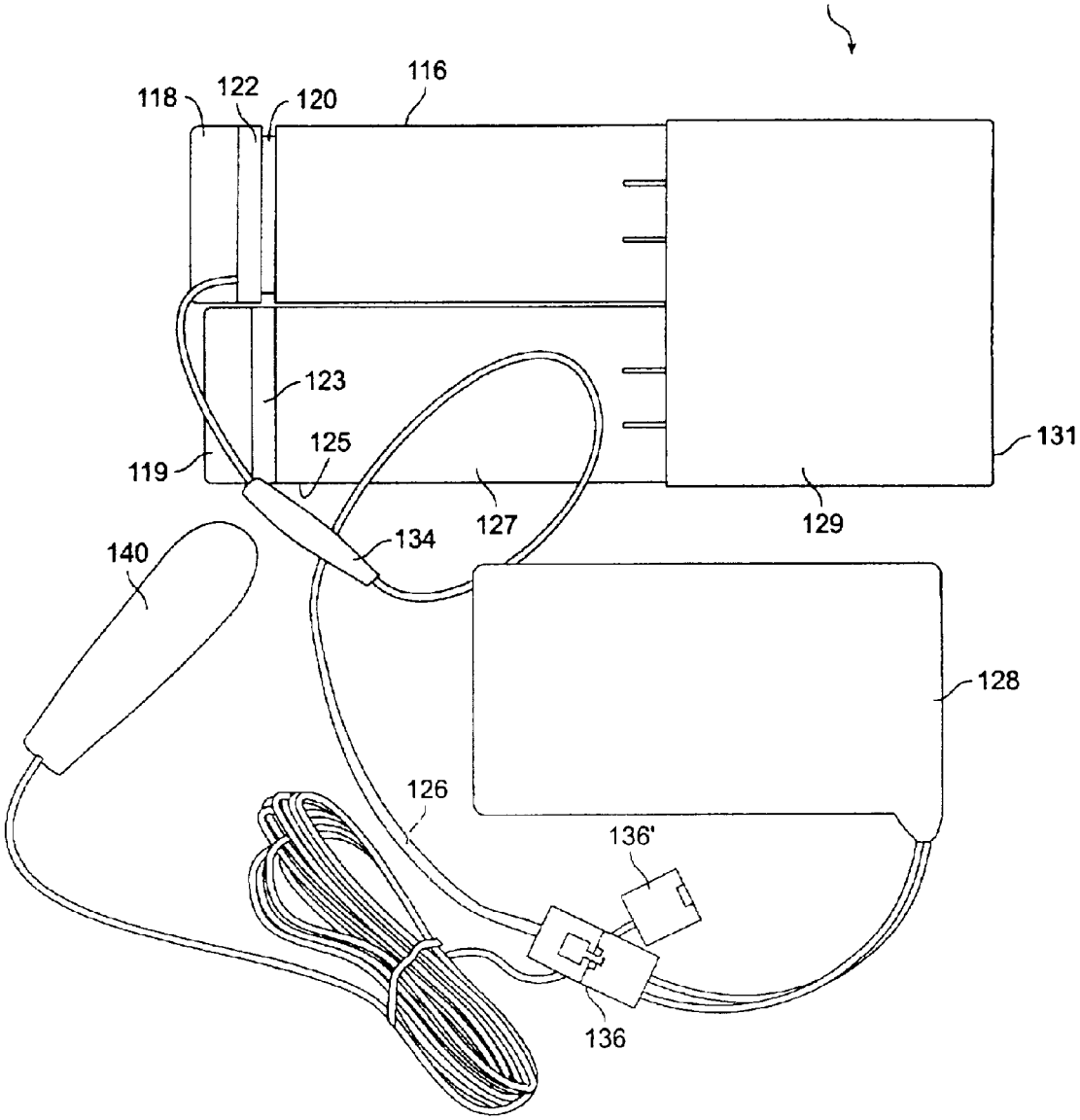
FIG. 7 is a front view of an alternate embodiment of the invention wherein dual fans, and dual fan motors, are provided, and wherein a battery pack and cigarette lighter adaptor may alternately be coupled to the quick-disconnect coupling for powering the fan motors.

For improved cooling capacity, cooling device 14 can be modified to incorporate a second fan. As shown in FIG. 7, dual-fan cooling device 114 includes a first fan 118 and a second fan 119. Fan 118 is powered by motor 122, and fan 119 is powered by motor 123. Fan 118 is pivotally secured to the upper end 120 of elongated housing 116, and fan 119 is pivotally secured to the upper end 125 of elongated housing 127. Electrical wires 126 can be coupled in parallel with the first electric motor associated with fan 118, and with the second electric motor associated with fan 119, to power both fans simultaneously, or the fans can be controlled individually. As before, battery pack 128 can be used to supply electrical power, or adaptor 140 can be used to supply power from a vehicle cigarette lighter. Electrical wires 126 can include an electrical switch 134 to selectively power fans 118 and 119. Quick-disconnect couplers 136 and 136' can be used as before to quickly decouple cooling device 114 from the source of electrical power, as desired.

Still referring to FIG. 7, base region 129 is affixed to two retractable extension members (not shown). One of such extension members retracts into, or extends from, elongated housing 116, and the other extension member retracts into, or extends from, elongated housing 127. Ventilation holes (not shown) may be provided within the side walls of elongated housings 116 and 127, within sidewalls of the two extension members, and within the sidewalls of base region 129, to discharge fresh air between the protective vest and the user's body. In addition, the lower end 131 of base region 129 may be left open to discharge fresh air. As base region 129 is pulled apart from elongated housings 116 and 127, the two extension members initially retracted within housings 116 and 127 are extended therefrom, thereby effectively lengthening cooling device 114.

As mentioned above, another aspect of the present invention relates to a method of cooling a person who is wearing a protective vest. In practicing such method, a fan, such as fan 18, is supported at the upper end of an elongated housing, e.g., housing 16. An electric motor, e.g., motor 22, is coupled to, and rotates, fan 18 to draw fresh air into the upper end of the elongated housing. Electrical power is supplied, as by a battery pack 28 worn by the user or by a vehicle cigarette light adapter 40, for example, to the electric motor to rotate the fan. The elongated housing is inserted into the protective vest, in the general manner shown in FIGS. 1–4, while positioning fan 18 just outside the neck opening of the protective vest, preferably just ahead of, or just behind, the user's neck. One or more ventilation holes are formed in the elongated housing below its upper end, and fresh air drawn in by the fan is discharged through the ventilation hole between the protective vest and the user's body.

As described above, the cooling method of the present invention preferably includes releasably coupling the motor to the source of electrical power by a quick-disconnect coupling 36. The method may also include the step of interposing an electrical switch 34 and/or rheostat 34' between motor 22 and the source of electrical power to selectively adjust the speed of fan 18. The method of the present invention also preferably includes the step of slidingly engaging a retractable extension member 50 with the lower end of elongated housing 16 to adjust the length thereof. Such method also preferably includes the step of forming one or more ventilation holes 60/62 within the retractable extension member 50 for discharging fresh air between the protective vest and the body of the user.

Those skilled in the art will now appreciate that a simple and inexpensive cooling device has been described for circulating fresh, cooling air between a protective vest and the user's body. The described cooling device is adapted to be used both within a motor vehicle as well as remote from the motor vehicle, and can easily be adapted to existing protective vests already in use by law enforcement officers. The cooling device described herein can be quickly and easily disconnected from an electrical power source when necessary to avoid interference with a law enforcement officer's duties in times of emergency; indeed, the entire cooling device itself can be quickly and easily inserted or removed by a user. Moreover, the overall length, and fresh air discharge pattern, provided by the cooling device described above can be easily adjusted by a user to suit the specific needs of the user.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

I claim:

1. A protective vest assembly having a cooling system, the protective vest comprising in combination:

a. a protective vest for being worn over the body of a user, the protective vest having a pair of arm holes for allowing a user to extend the user's arms therethrough, and having a neck opening for allowing the user's neck to extend the therethrough;

b. an elongated housing generally disposed inside the protective vest, the elongated housing having an upper end and an opposing lower end;

c. a first fan supported at the upper end of the elongated housing and extending outside the neck opening of the protective vest for drawing fresh air into the upper end of the elongated housing;

d. a first electric motor supported proximate the upper end of the elongated housing and coupled to the first fan for rotating the first fan;

e. the elongated housing having at least one ventilation hole formed therein below the upper end thereof for circulating fresh air between the protective vest and the body of the user; and f. electrical wires coupled to the first electric motor for supplying electrical power thereto.

2. The protective vest assembly recited by claim 1 including a battery electrically coupled to the electrical wires for supplying electrical power to the first electric motor.

3. The protective vest assembly recited by claim 2 wherein the battery is worn upon the user's person.

4. The protective vest assembly recited by claim 3 wherein the battery is supported from a belt worn by the user.

5. The protective vest assembly recited by claim 2 wherein the electrical wires include a quick-disconnect coupling for releasably coupling the battery to the first electric motor.

6. The protective vest assembly recited by claim 2 further including an electrical switch coupled with the electrical wires to selectively couple the battery to the first electric motor.

7. The protective vest assembly recited by claim 1 including an electrical adaptor electrically coupled to the electrical wires and adapted to engage a vehicle cigarette lighter in order to supply electrical power from a vehicle to the first electric motor.

8. The protective vest assembly recited by claim 7 wherein the electrical wires include a quick-disconnect coupling for releasably coupling the vehicle cigarette lighter to the first electric motor.

9. The protective vest assembly recited by claim 1 wherein the elongated housing includes a retractable extension slidingly received within the lower end of the elongated housing, the retractable extension being extendable from the lower end of the elongated housing to effectively lengthen the elongated housing, the retractable extension having at least one ventilation hole formed therein for circulating fresh air between the protective vest and the body of the user when the retractable extension is extended from the lower end of the elongated housing.

10. The protective vest assembly recited by claim 9 wherein the retractable extension has an upper end which remains within the elongated housing and an opposing lower end, and wherein the lower end of the retractable extension in open for discharging fresh air therefrom.

11. The protective vest assembly recited by claim 1 further including:

a. a second fan supported at the upper end of the elongated housing adjacent the first fan and extending outside the neck opening of the protective vest for drawing fresh air into the upper end of the elongated housing;

b. a second electric motor supported proximate the upper end of the elongated housing and coupled to the second fan for rotating the second fan;

c. the electrical wires being coupled to the second electric motor for supplying electrical power thereto.

12. The protective vest assembly recited by claim 1 wherein the first fan extends outside the neck opening of the protective vest proximate a frontal portion of the user's neck.

13. The protective vest assembly recited by claim 1 wherein the first fan extends outside the neck opening of the protective vest proximate a rear portion of the user's neck.

14. The protective vest assembly recited by claim 1 further including an electrical dimmer switch coupled with the electrical wires to selectively couple a variable electrical current to the first electric motor for varying the speed of the first electrical motor.

15. A method of cooling a person using a protective vest, the protective vest being worn over the body of a user, the protective vest having a pair of arm holes for allowing the user to extend the user's arms therethrough, and having a neck opening for allowing the user's neck to extend therethrough, the method comprising the steps of:

a. providing an elongated housing having upper and lower opposing ends;

b. supporting a first fan at the upper end of the elongated housing;

c. coupling a first electric motor to the first fan for rotating the first fan to draw fresh air into the upper end of the elongated housing;

d. inserting the elongated housing into the protective vest, and positioning the first fan outside the neck opening of the protective vest e. forming at least one ventilation hale in the elongated housing below the upper end thereof;

f. circulating fresh air through the at least one ventilation hole between the protective vest and the body of the user; and g. supplying electrical power to the first electric motor for rotating the first fan.

16. The method of cooling a person using a protective vest recited by claim 15 wherein the step of supplying electrical power includes the step of electrically coupling a battery to the first electric motor.

17. The method of cooling a person using a protective recited by claim 16 including the step of supporting the battery upon the user's person.

18. The method of cooling a person using a protective vest recited by claim 17 wherein the step of supporting the battery upon the user's person includes the step of supporting the battery from a belt worn by the user.

19. The method of cooling a person using a protective vest recited by claim 16 wherein the step of electrically coupling the battery to the first electric motor includes the step of providing a quick-disconnect coupling to releasably couple the battery to the first electric motor.

20. The method of cooling a person using a protective vest recited by claim 16 further includes the step of interposing an electrical switch between the battery and the first electric motor to selectively couple the battery to the first electric motor.

21. The method of cooling a person using a protective vest recited by claim 15 wherein the step of supplying electrical power includes the step of electrically coupling the first electric motor to an electrical adaptor adapted to engage a vehicle cigarette lighter.

22. The method of cooling a person using a protective vest recited by claim 21 wherein the step of electrically coupling the first electric motor to the electrical adaptor includes the step of providing a quick-disconnect coupling to releasably couple the first electric motor to the electrical adaptor.

23. The method of cooling a person using a protective vest recited by claim 15 wherein the step of providing an elongated housing includes the steps of slidingly engaging a retractable extension with the lower end of the elongated housing to effectively lengthen the elongated housing, and forming at least one ventilation hole within the retractable extension for circulating fresh air between the protective vest and the body of the user when the retractable extension is extended from the lower end of the elongated housing.

24. The method of cooling a person using a protective vest recited by claim 23 including the step of discharging fresh air from a lower end of the retractable extension.

25. The method of cooling a person using a protective vest recited by claim 15 further including the steps of:

a. supporting a second fan at the upper end of the elongated housing;

b. coupling a second electric motor to the second fan for rotating the second fan to draw fresh air into the upper end of the elongated housing; and c. supplying electrical power to the second electric motor for rotating the second fan.

26. The method of cooling a person using a protective vest recited by claim 15 including the step of positioning the first fan outside the neck opening of the protective vest proximate a frontal portion of the user's neck.

27. The method of cooling a person using a protective vest recited by claim 15 including the step of positioning the first fan outside the neck opening of the protective vest proximate a rear portion of the user's neck.

* * * * *